US011754233B1

(12) United States Patent
Hwang

(10) Patent No.: US 11,754,233 B1
(45) Date of Patent: Sep. 12, 2023

(54) MULTIFUNCTIONAL CAMPING LIGHT

(71) Applicant: METROMAX AMERICA CORPORATION, Rowland Heights, CA (US)

(72) Inventor: Christina Hwang, Rowland Heights, CA (US)

(73) Assignee: METROMAX AMERICA CORPORATION, Rowland Heights, CA (US)

( * ) Notice: Subject to any disclaimer, the term of this patent is extended or adjusted under 35 U.S.C. 154(b) by 0 days.

(21) Appl. No.: 18/080,272

(22) Filed: Dec. 13, 2022

(51) Int. Cl.

| | |
|---|---|
| ***F21L 4/02*** | (2006.01) |
| ***F21L 2/00*** | (2006.01) |
| ***F21V 23/04*** | (2006.01) |
| ***F21V 23/06*** | (2006.01) |
| ***F21V 21/30*** | (2006.01) |

(52) U.S. Cl.
CPC ..... *F21L 4/022* (2013.01); *F21L 2/00* (2013.01); *F21V 21/30* (2013.01); *F21V 23/0414* (2013.01); *F21V 23/06* (2013.01)

(58) Field of Classification Search
CPC .. F21L 4/022; F21L 2/00; F21V 21/30; F21V 23/0414; F21V 23/06
See application file for complete search history.

(56) References Cited

FOREIGN PATENT DOCUMENTS

| | | | | |
|---|---|---|---|---|
| DE | 202021106698 U1 * | 2/2022 | | |
| WO | WO-2009111184 A2 * | 9/2009 | ..... | F21L 2/00 |
| WO | WO-2018106616 A1 * | 6/2018 | ..... | F21L 2/00 |

* cited by examiner

*Primary Examiner* — Anabel Ton
(74) *Attorney, Agent, or Firm* — BACON & THOMAS, PLLC

(57) ABSTRACT

A multifunctional camping light includes a receptacle and at least two movable light bodies separately having an independent battery, and the two movable light bodies separately have a solar panel for providing an automatic charge or charging the receptacle. Unlike the function of the conventional camping lights available on the market, the movable light body of this disclosure can be assembled onto the receptacle in different ways to emit light or removed and used as a flashlight or a wall light to satisfy various different requirements of power bank and illumination for outdoor camping.

11 Claims, 10 Drawing Sheets

MULTIFUNCTIONAL CAMPING LIGHT

FIELD OF THE INVENTION

The present disclosure relates to a multifunctional camping light which includes a receptacle having an independent battery, and at least two movable light bodies detachably installed onto the receptacle, and the two movable light bodies separately have a solar panel for automatically charging the movable light bodies or charging the receptacle, and the receptacle an also be used as a power bank. The technical contents of the overall structure relate to solar charging, power bank, flashlight, and illuminating light, and this multifunctional camping light can satisfy various different requirements of power bank and illumination for outdoor camping.

BACKGROUND OF THE INVENTION

Activities such as outdoor camping and mountaineering allow us to profoundly learn about natural ecology, relax our body and mind, and thus become a top choice for recreation. For camping, a camping light is one of the necessary items, and it can be divided into an LED lamp, a gas lamp, a kerosene gasification lamp and a candle lamp, etc. according to the type of energy source. Among them, the LED camping light uses a storage battery to supply electric power to emit light. Compared with the kerosene, gas or candle camping lights, the LED camping light is safer to use and can be used in tents safely.

The quantity of camping lights used is usually adjusted according to the number of people and the number of tents. In general, a one-person camp needs a camping light placed in the tent, and another one placed outside the tent. If the number of participants increases, the number of tents used becomes larger, the places where the camping lights are needed will increase, but the carrying of many camping lights will increase the weight and volume of the backpack. Obviously, there is a need for improvement.

To overcome the aforementioned problems, there is a general lantern with removable lights on the market, and such lantern includes a cylindrical docking station, and a plurality of tile-shaped area lights detachably installed around the periphery of the receptacle, and the docking station and the plurality of area lights have storage batteries respectively, and the storage battery of the docking station adopts a general 1.5V rechargeable battery, which can provide the electric power for the plurality of area lights when the area light electric power is insufficient.

During use, the plurality of area lights can be assembled to the periphery of the docking station to illuminate the surroundings, or the area lights can be disassembled from the docking station and used for small-scale lighting alone, so that users can place the area lights in any position that requires lighting as needed to overcome the problems caused by carrying too many camping lights, but the disadvantage is that the area light cannot be charged automatically, so that the users need to carry a spare battery to maintain the lighting, or get the electric power from the docking station. However, when the power level of the storage battery of the docking station is low or exhausted, the docking station will be unable to function, and thus the benefit of use is limited.

In summation of the aforementioned problems of the prior art, the first is that the battery life of the docking station and the area lights is limited. For long-term camping, when the power of storage battery is exhausted, it is not easy for the users to obtain an external power supply outdoors, and the structure of the docking station and area lights does not allow automatic charge, so that the users have to carry a spare battery for replacement, which will increase the burden of luggage. Furthermore, the users cannot carry enough spare batteries for replacement in practical situations.

The second is that the camping light has a single lighting direction, and the plurality of area lights are arranged around the side of the receptacle, and there is only one kind of combination, so that when any area light is assembled to the docking station, the area light cannot adjust the lighting direction, and the angle of lighting is limited.

The third is that the camping light only has a single function. When camping, the users may need a spotlight or other electronic devices that also require to be charged, and thus causing the users to carry the spotlight or a power bank in addition, wherein the spotlight has the function of concentrating and focusing the light to provide a farther lighting distance which is incomparable by the camping light. Therefore, how to improve the power storage and lighting direction of the camping light, and expand the function of the camping light is the subject of this disclosure.

SUMMARY OF THE INVENTION

Specifically, the present disclosure is directed to a multifunctional camping light, which includes a receptacle, and at least two movable light bodies detachably installed onto the receptacle, and the receptacle and the two movable light bodies separately have an independent power supply, characterized in that:

The receptacle is substantially in a column shape and has a top side, and at least two longitudinal grooves formed on a lateral side of the receptacle and the top side of the receptacle is provided with a control switch and a power I/O interface capable of inputting an external power supply, storing electric power, or outputting electric power to supply power to an external electronic device; each longitudinal groove is provided for vertically installing a movable light body, and has an inner wall, a top and a bottom, and the bottom of the longitudinal groove is provided with a first terminal module, and the top of the longitudinal groove is concavely formed with a transverse groove for installing one of the movable light bodies horizontally, and the transverse groove is provided with a second terminal module.

Each movable light body is substantially in a flat shape, and separately has a first functional surface defined on a solar panel, a second functional surface defined on a light-emitting light board and configured to be opposite to the first functional surface, a first end portion formed on a projecting lamp, a second end portion and an operating switch formed on a third terminal module.

When the movable light body is vertically assembled into one of the longitudinal grooves of the receptacle, the first functional surface abuts against the inner wall of the longitudinal groove, and the second functional surface faces outward relative to the receptacle, and the third terminal module is electrically connected to the first terminal module of the longitudinal groove, so that the control switch of the receptacle can control the second functional surface of the movable light body to emit lights outward and charge the movable light body.

When the movable light body is horizontally assembled into one of the transverse grooves of the receptacle, the first functional surface faces upward, and the second functional surface faces downward, and the second end portion is plugged and positioned into the transverse groove, such that the third terminal module is electrically connected to the second terminal module, and the control switch of the receptacle can control the second functional surface of the movable light body to emit light downward, and the solar panel facing upward can receive and convert solar radiation into electrical energy for charging the movable light body or the receptacle.

When any movable light body is removed from the receptacle, the operating switch of the movable light body can be used for controlling the light-emitting light board on the second functional surface or the projecting lamp of the first end portion to emit light for the use as illuminating light or flashlight, and the solar panel can receive and convert solar radiation into electrical energy and store the electric energy in the movable light body.

Compared with the prior art, this disclosure has the following advantages:

1. The receptacle and each movable light body separately have an independent power supply, and the movable light body can be charged automatically through the solar panel. When the movable light body is horizontally assembled into the transverse groove of the receptacle, the solar panel of the movable light body can be used to charge the receptacle, so as to improve the power storage issue of the prior art camping light.
2. The receptacle has the longitudinal groove and the transverse groove, so that the movable light body can be selectively onto the receptacle in the vertical or horizontal direction for charging or lighting, so as to improve the issue of unable to adjust the lighting direction after the prior art area lights and docking station are assembled to each other.
3. The movable light body can be used independently as a flashlight or a wall lamp, and the receptacle inputs external power supply through the power I/O interface to store electric power, or output the electric power to an external electronic device as a power supply, which is used as a power bank to expand the function of the camping light and satisfy various different requirements of power bank and illumination for outdoor camping.

The objectives, technical characteristics and effects of the present invention will become apparent with the detailed description of preferred embodiments accompanied with the illustration of related drawings. It is intended that the embodiments and drawings disclosed herein are to be considered illustrative rather than restrictive.

DESCRIPTION OF THE PREFERRED EMBODIMENTS

Figure 1:
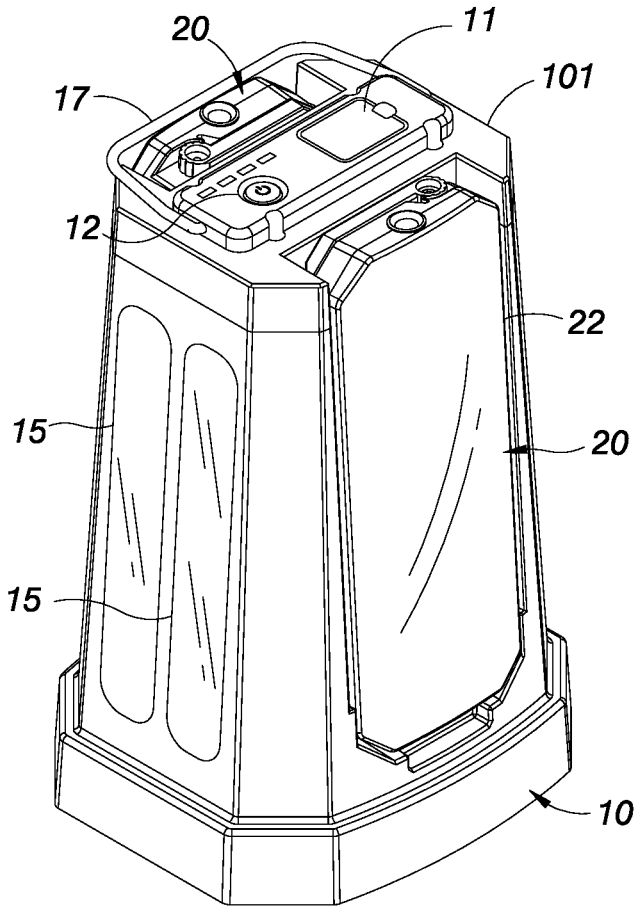
FIG. 1 is a perspective view of this disclosure.
Figure 2:
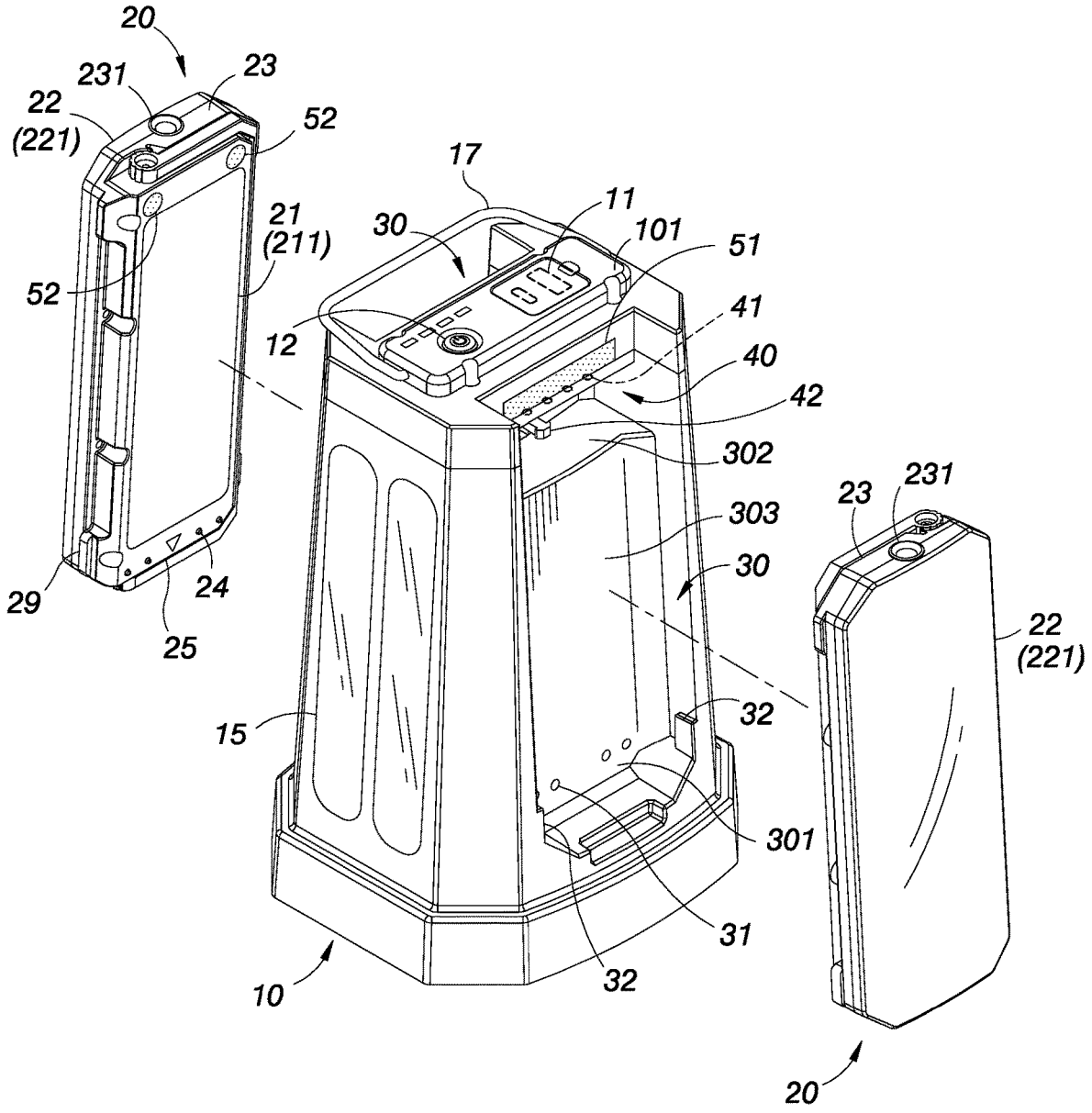
FIG. 2 is an exploded view of a first embodiment of this disclosure.
Figure 3:
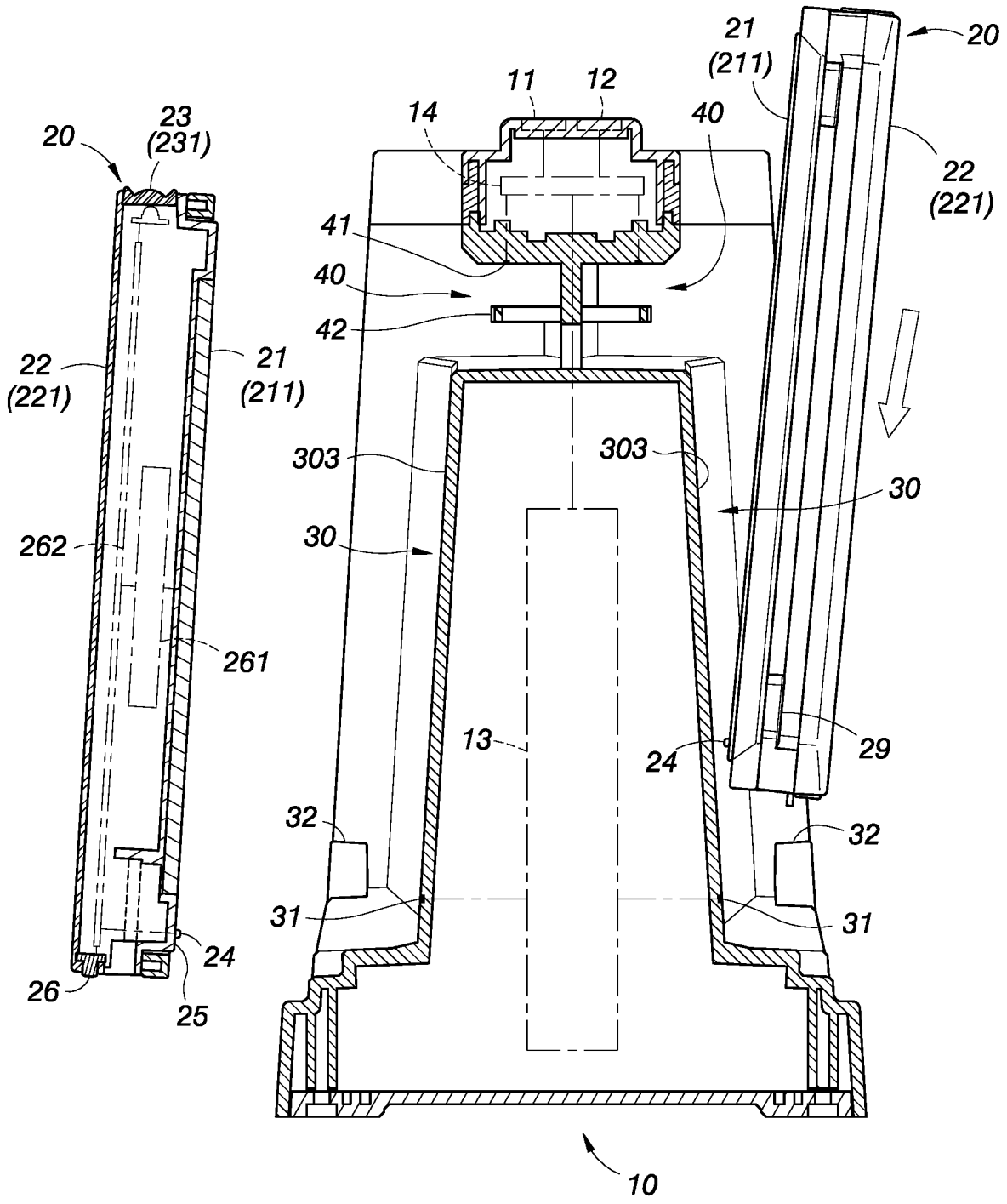
FIG. 3 is a schematic view showing a receptacle and a movable light body in accordance with the first embodiment of this disclosure.

With reference to FIGS. 1-3 for a multifunctional camping light of this disclosure, the multifunctional camping light includes a receptacle 10, and at least two movable light bodies 20 detachably installed onto the receptacle 10, and the receptacle 10 and the two movable light bodies 20 separately have an independent power supply.

The receptacle 10 is substantially in a column shape, and the top side 101 of the receptacle 10 is provided with a power I/O interface 11 and a control switch 12, and the lateral side of the receptacle 10 is provided with at least two longitudinal grooves 30, and each longitudinal groove 30 is provided for installing any movable light body 20 in a vertical direction.

The bottom 301 of the longitudinal groove 30 is provided with a first terminal module 31, and the top 302 of the longitudinal groove 30 is provided with a transverse groove 40, and the transverse groove 40 is provided for installing one of the movable light bodies 20 in a horizontal direction, and the transverse groove 40 is provided with a second terminal module 41.

The power I/O interface 11, the control switch 12, the first terminal module 31 and the second terminal module 41 of the receptacle 10 are respectively and electrically connected to a storage battery 13 and a control circuit board 14 in the receptacle 10, and the receptacle 10 can output external power supply through the power I/O interface 11 to charge the storage battery 13, or output electric power to an external electronic device (not shown in the figure) as a power supply. In an embodiment, the power I/O interface 11 includes but not limited to the USB type C and USB type A interface, and the outside of the power I/O interface 11 is provided with a waterproof cover, and a power indicating light to prevent the power I/O interface 11 from being damaged by moisture, and the power indicating light is provided for indicating the level of electric power of the storage battery 13, which is used to remind users.

Each movable light body 20 is substantially in a flat shape, and has a first functional surface 21, a second functional surface 22 opposite to the first functional surface 21, a first end portion 23, a second end portion 25 with a third terminal module 24, and an operating switch 26.

The first functional surface 21 is provided with a solar panel 211, and the second functional surface 22 is provided with a light-emitting light board 221, and the first end portion 23 is provided with a projecting lamp 231, and the light-emitting light board 221, the solar panel 211, the projecting lamp 231, the third terminal module 24 and the operating switch 26 are respectively and electrically connected to a battery 261 and a circuit board 262, such that the operating switch 26 can be used to control the light-emitting light board 221 or projecting lamp 231 to emit light, and the battery 261 can store electric power and supply the electric power required by the operation of the movable light body 20.

Figure 4:
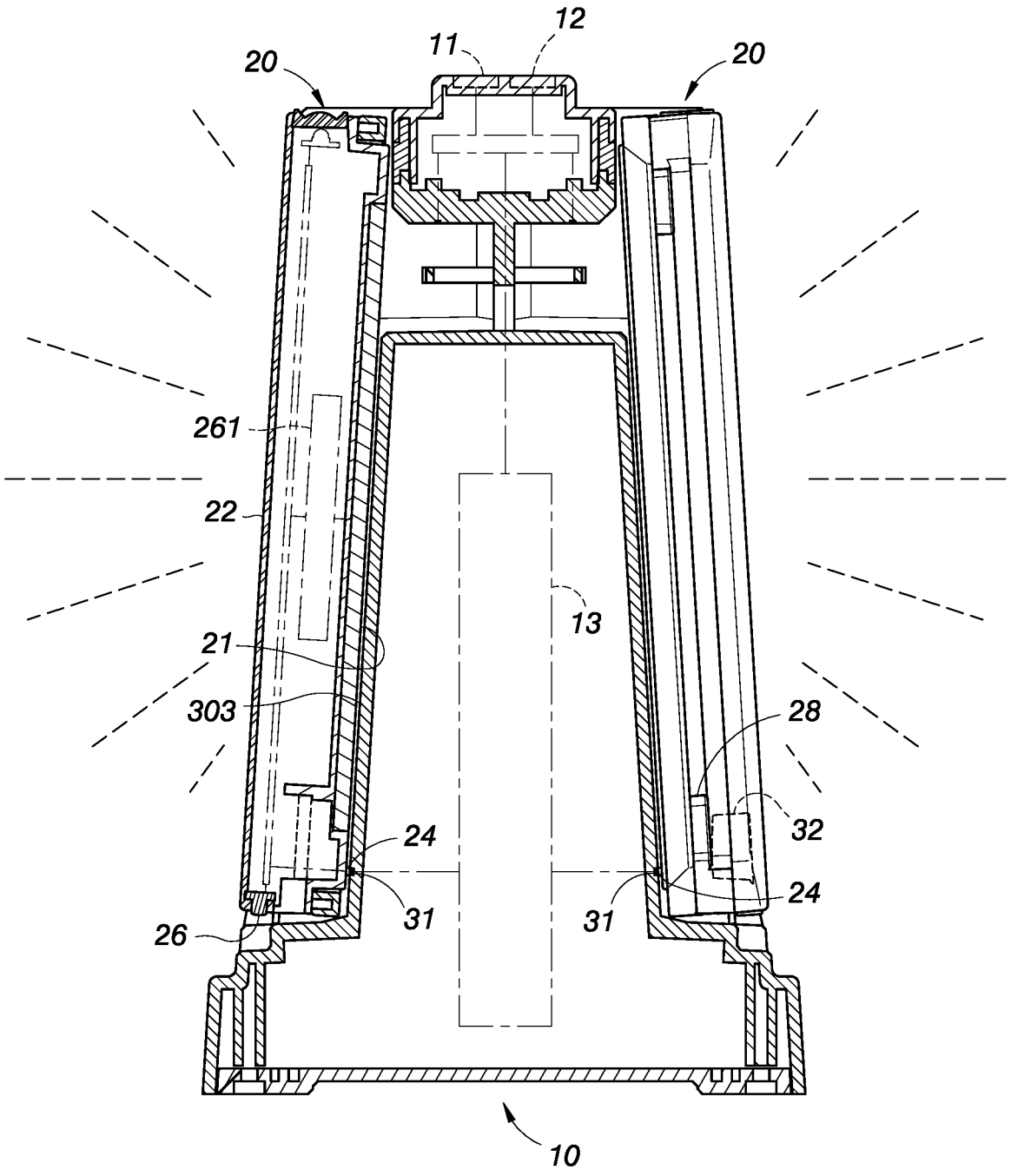
FIG. 4 is a schematic view showing two movable light bodies assembled with two longitudinal grooves in accordance with the first embodiment.

In FIGS. 3 and 4, when any movable light body 20 is vertically assembled into one of the longitudinal grooves 30 of the receptacle 10, the first functional surface 21 abuts against an inner wall 303 of the longitudinal groove 30, and the second functional surface 22 faces outward relative to the receptacle 10, and the third terminal module 24 is electrically connected to the first terminal module 31 of the longitudinal groove 30, such that the control switch 12 of the receptacle 10 can control the light-emitting light board 221 on the second functional surface 22 of the movable light body 20 to emit light outward, and the storage battery 13 of the receptacle 10 can supply electric power to the two movable light bodies 20 through the third terminal module 24 and the first terminal module 31.

Figure 5:
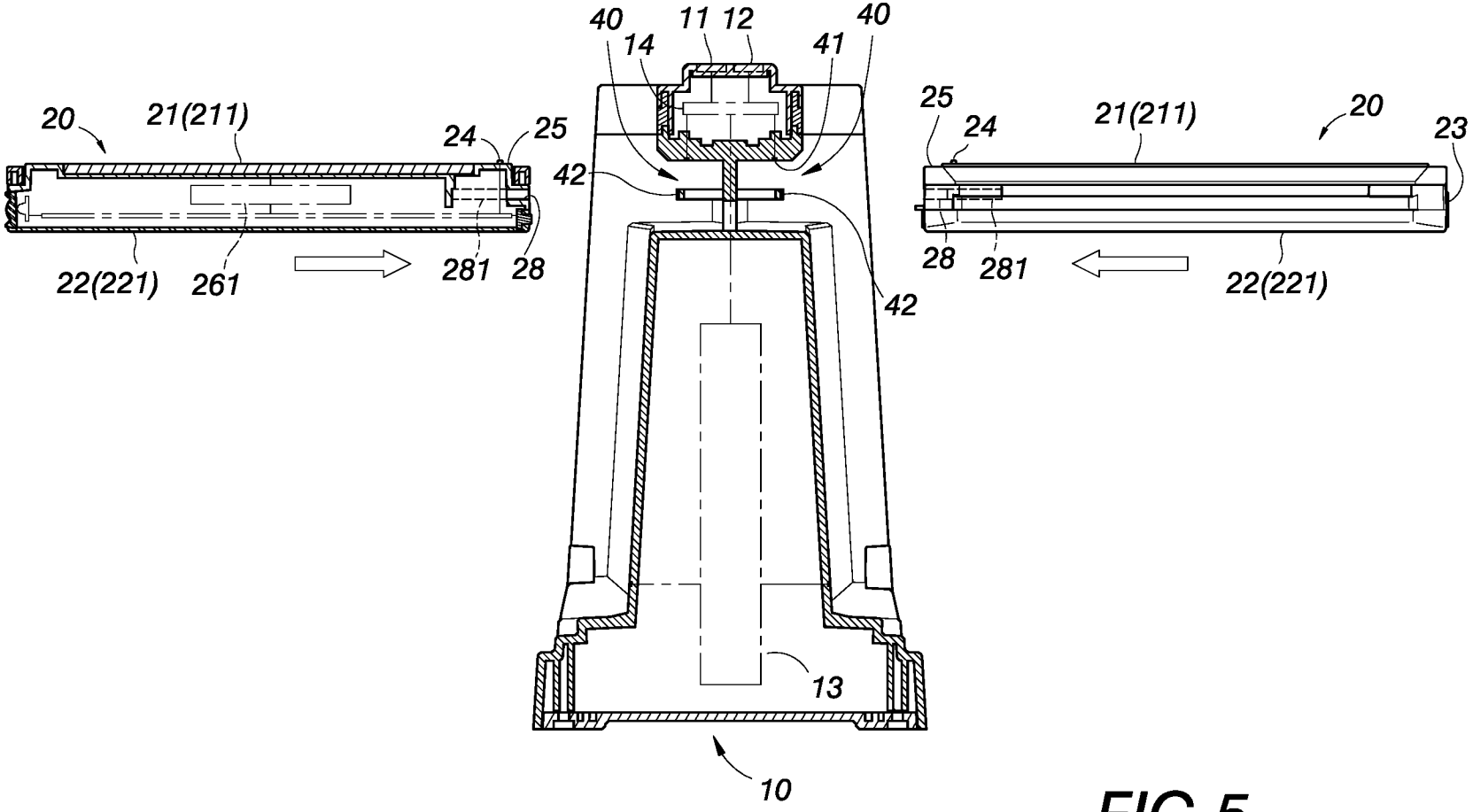
FIG. 5 is a schematic view showing two movable light bodies ready to be assembled with two longitudinal grooves respectively in accordance with the first embodiment of this disclosure.
Figure 6:
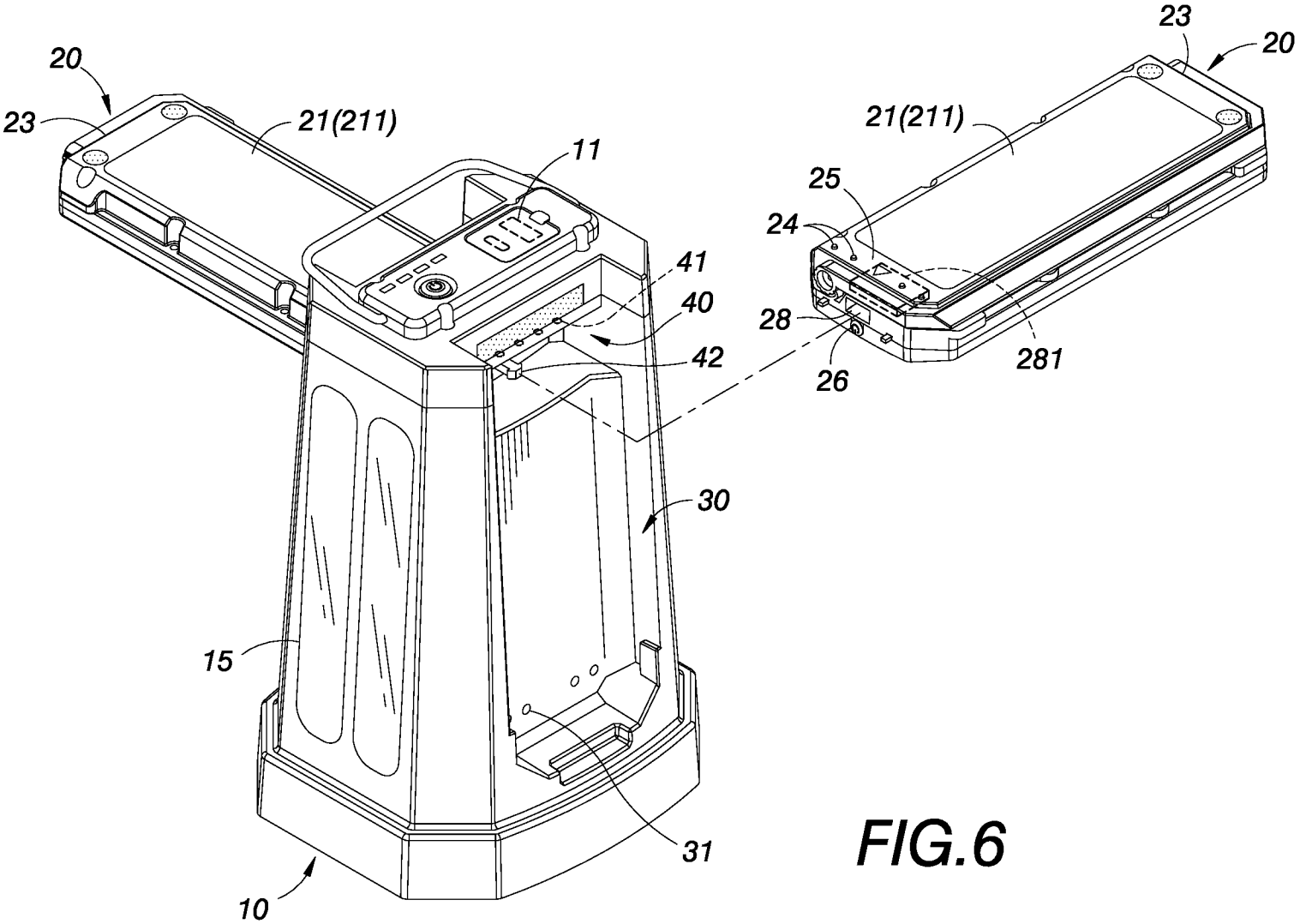
FIG. 6 is a perspective view showing one of the movable light bodies ready to be assembled with a transverse groove in accordance with the first embodiment this disclosure.
Figure 7:
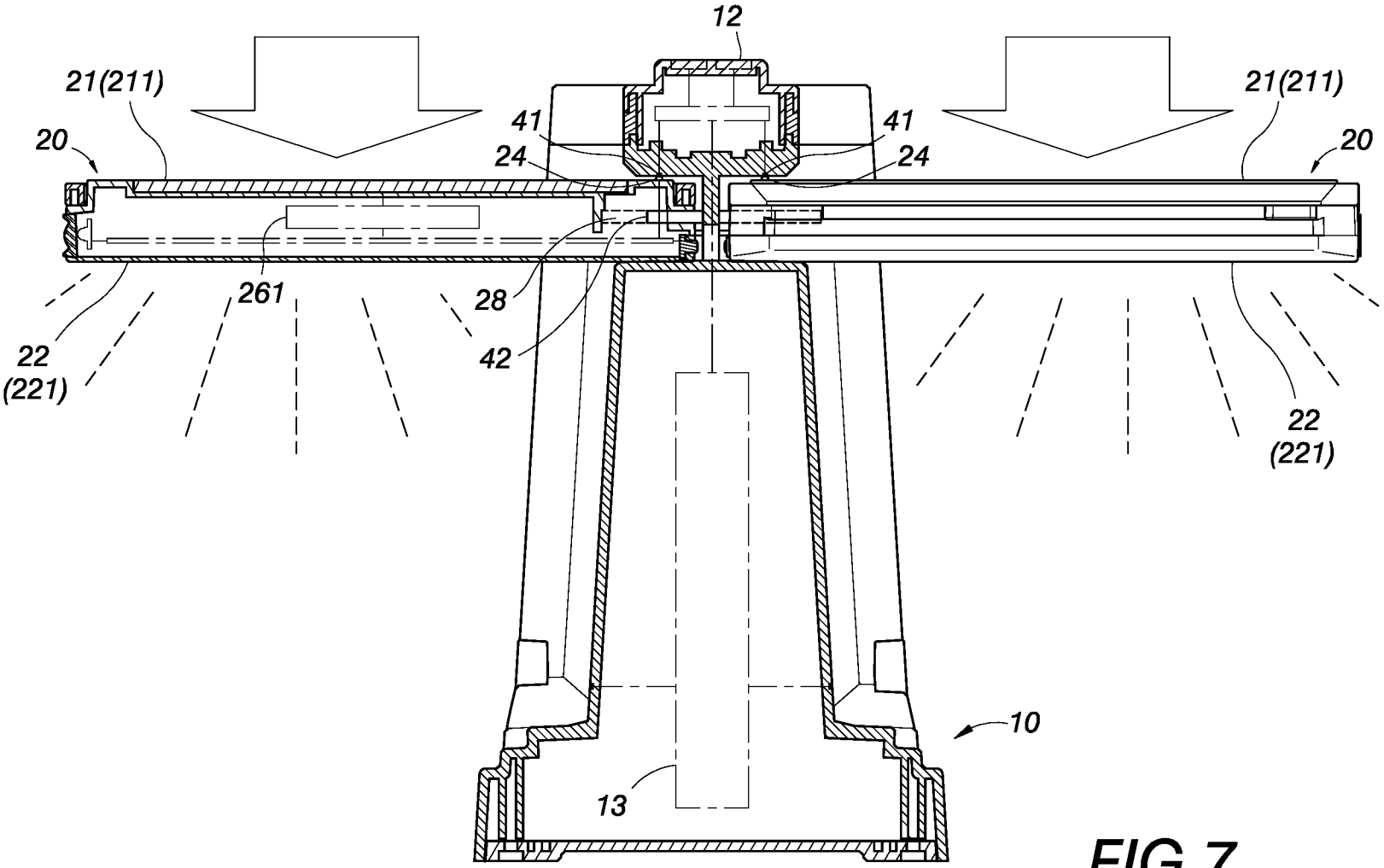
FIG. 7 is a schematic view showing two movable light bodies ready to be assembled with two transverse grooves respectively in accordance with the first embodiment.

In FIGS. 5 to 7, when any movable light body 20 is horizontally assembled into one of the transverse grooves 40 of the receptacle 10, the first functional surface 21 faces upward, and the second functional surface 22 faces downward, and the second end portion 25 is plugged and positioned in the transverse groove 40, such that the third terminal module 24 is electrically connected to the second terminal module 41 of the transverse groove 40, and the control switch 12 of the receptacle 10 can control the light-emitting light board 221 on the second functional surface 22 of the movable light body 20 to emit light downward, and the solar panel 211 facing upward can receive and convert solar radiation into electrical energy, for charging the battery 261 of the movable light body 20 or the storage battery 13 of the receptacle 10 to overcome the power consumption issue when the camping light is used for a long time.

Figure 8:
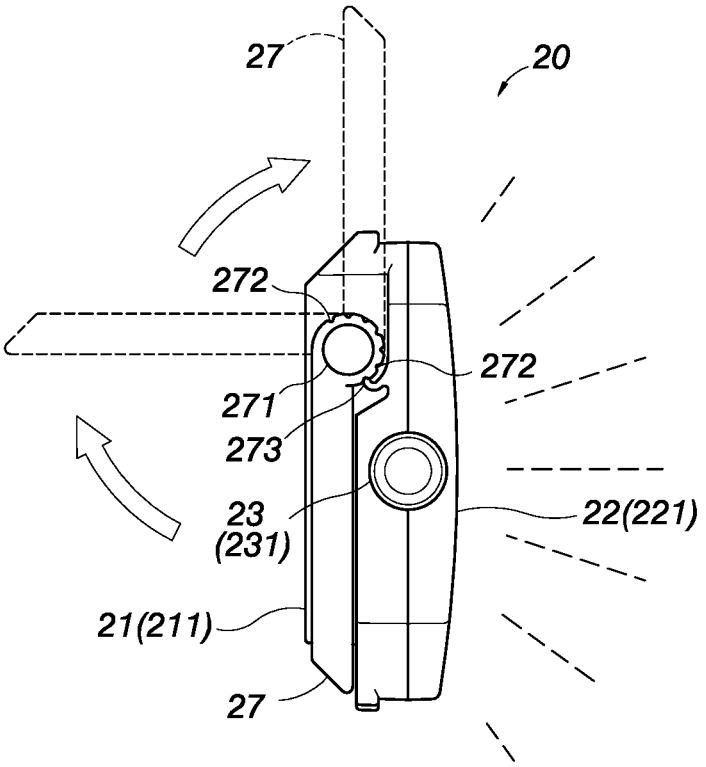
FIG. 8 is a schematic view of a movable light body independently used as an illuminating light in accordance with the first embodiment.
Figure 9:
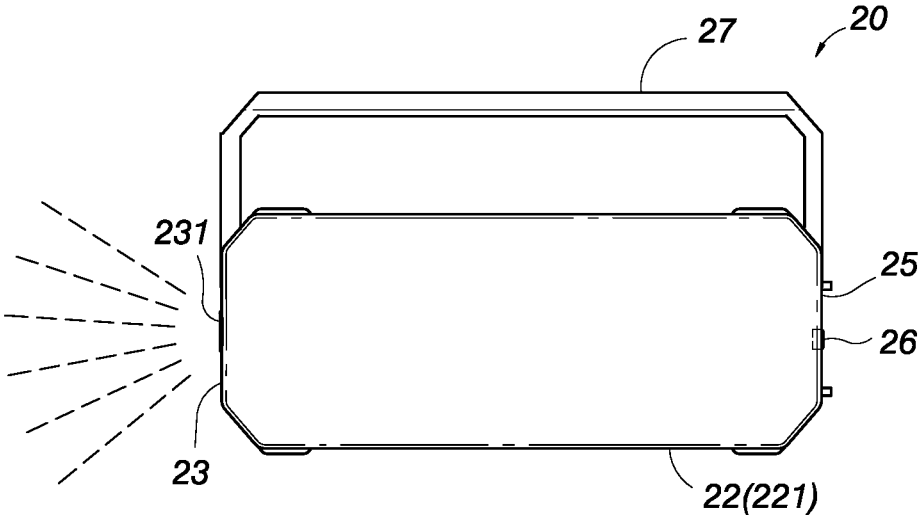
FIG. 9 is a schematic view of a movable light body independently used as a flashlight in accordance with the first embodiment.

When any movable light body 20 is removed from the receptacle 10 as shown in FIGS. 8 and 9, the operating switch 26 of the movable light body 20 can control the light-emitting light board 221 on the second functional surface 22 or the projecting lamp 231 at the first end portion 23 to emit light which is used as an illuminating light or a flashlight, and the solar panel 211 can receive and convert solar radiation into electrical energy which is stored in the movable light body 20.

With the aforementioned structure, any movable light body 20 of this disclosure as shown in FIGS. 4 and 5 can be selectively assembled onto the receptacle 10 in a vertical or horizontal direction for providing light in different directions or charging. One of the movable light bodies 20 can be vertically assembled onto the receptacle 10 and the other one movable light body 20 is horizontally assembled onto the receptacle 10, such that the two movable light bodies 20 can provide light in different direction simultaneously; or any movable light body 20 is used independently as an illuminating light or a flashlight to provide several ways of applications and overcome the drawbacks of the commercially available products that the lighting direction cannot be adjusted, a spare battery is required, and the user needs to carry an additional flashlight.

In addition, when the two movable light bodies 20 are assembled onto the receptacle 10, the control switch 12 of the receptacle 10 can be used to control the two movable light bodies 20 to emit light, so as to allow users to individually operate the operating switch 26 of each movable light body 20, and improve convenience of use.

In FIGS. 2, 8 and 9, the top side 101 of the receptacle 10 is further provided with a force applying handle 17, and the two movable light bodies 20 separately have a handle 27, and the force applying handle 17 and the handle 27 are used to provide the users to hang the receptacle 10 or the movable light body 20 for the use as a hanging lamp or a wall lamp.

In an embodiment, both sides of the handle 27 of the movable light body 20 are separately provided with a pivot shaft 271 which is pivotally connected to the first end portion 23 and the second end portion 25 respectively, and the outer edges of the two pivot shafts 271 are provided with a plurality of notches 272, and the first end portion 23 and the second end portion 25 are provided with at least one elastic positioning buckle 273 disposed across one of the notches 272 to allow users to operate the handle 27 to deviate relative to the movable light body 20, and the elastic positioning buckle 273 disposed across one of the notches 272 can elastically restore its original position to produce an obvious feeling of different sections, and can also position the handle 27 after it is deflected for an angle, so that the users can adjust a desired angle for the use.

It is noteworthy that in terms of electric power supply as shown in FIG. 6, the receptacle 10 of this disclosure has an independent power supply, and the receptacle 10 is provided with a power I/O interface 11, so that the receptacle 10 can be used as a power bank for supplying power to the external electronic device; and the movable light body 20 is provided with a solar panel 211 capable of receiving and converting solar radiation into electrical energy and storing the electric energy. When the movable light body 20 is horizontally assembled in the transverse groove 40 of the receptacle 10, the solar panel 211 upward facing can also charge the movable light body 20 first, and then recharge the receptacle 10, so as to overcome the power consumption problem when the camping light is used for a long time.

The components of this embodiment are further elaborated as follows:

In FIGS. 5 to 7, a positioning column 42 is provided inside the transverse groove 40 in accordance with an embodiment, and the second end portion 25 of the movable light body 20 is provided with a positioning hole 28 relative to the positioning column 42, and an elastic positioning plate 281 is provided in the positioning hole 28; when the movable light body 20 is horizontally assembled into the transverse groove 40, the positioning column 42 of the transverse groove 40 is detachably embedded in the positioning hole 28 of the movable light body 20, and elastically positioned by the elastic positioning plate 281 to prevent the movable light body 20 from separating from the transverse groove 40, so as to achieve the effect of stable positioning, and at the same time, the third terminal module 24 of the movable light body 20 can be connected to the second terminal module 41 of the transverse groove 40 to securely maintain the electrical connection state.

In an embodiment, the elastic positioning plate 281 can be a secondary pressing structure (such as a push-push latch), so that the positioning column 42 and the positioning hole 28 can be pressed twice to release the engagement under the latched state. In addition, the positioning column 42 is protruded from the inside of the transverse groove 40, and the positioning hole 28 is formed on the second end portion 25 of the movable light body 20, which can prevent the users from placing the first end portion 23 of the movable light body 20 in the wrong direction 23 to assemble it in the transverse groove 40, so as to provide a foolproof design.

Furthermore, the first functional surface 21 of the movable light body 20 is a plane, the second functional surface 22 is a curved surface, and the transverse groove 40 has a corresponding profile, so that when the movable light body 20 is horizontally assembled into the transverse groove 40, this arrangement can prevent the users from assembling the second functional surface 22 upward by mistake, thereby providing a foolproof design.

In FIGS. 2 to 4, both sides of the bottom 301 of the longitudinal groove 30 are respectively convexly provided with two stop blocks 32, and both sides of the second end portion 25 of the movable light body 20 opposite to the two stop blocks 32 are provided with two ribs 29, and when the movable light body 20 is vertically assembled into the longitudinal groove 30, the two ribs 29 of at the second end portion 25 of the movable light body 20 respectively abut against the rear sides of the two corresponding stop blocks 32, thereby preventing the movable light body 20 from separating from the longitudinal groove 30 to the outside.

In FIG. 2, the two longitudinal grooves 30 of the receptacle 10 are respectively provided with a first magnetic part 51, and each movable light body 20 is provided with a second magnetic part 52 separately at a position relative to the two first magnetic parts 51. When the movable light body 20 is vertically assembled onto the receptacle 10, the mutual attraction between the first magnetic part 51 and the second magnetic part 52 can assist the positioning of the movable light body 20 and allow the third terminal module 24 of the light body 20 and the first terminal module 31 of the longitudinal groove 30 to securely maintain an electrical connection state.

In the figures, the receptacle 10 is substantially in a rectangular column shape and has four sides. In FIG. 2, the two longitudinal grooves 30 are arranged on the corresponding two sides respectively in accordance with an embodiment, and the other two corresponding sides are provided with at least one second light-emitting light board 15, and the control switch 12 of the receptacle 10 can further control the two second light-emitting light boards 15 to emit light, so that after the users remove the two movable light bodies 20 from the receptacle 10, the receptacle 10 can emit light through two second light-emitting light boards 15.

Figure 10:
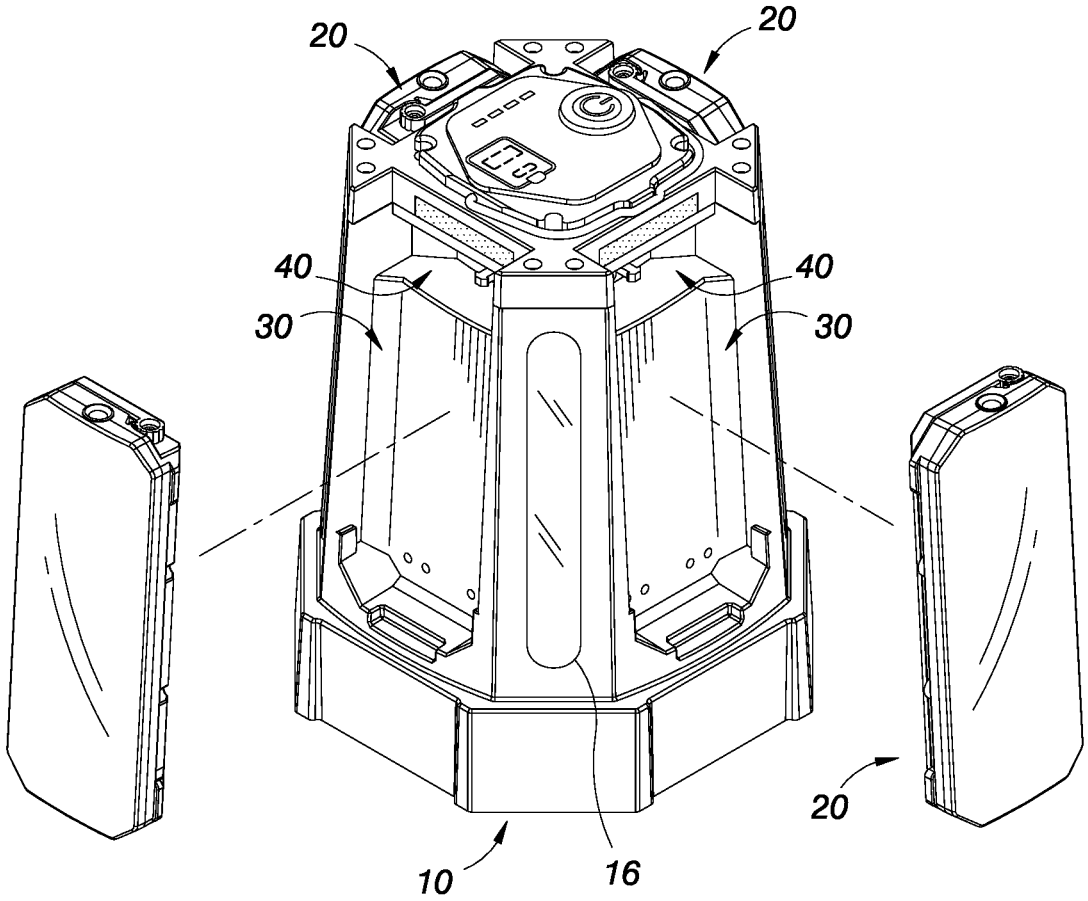
FIG. 10 is a schematic view of a combination of a movable light body and a longitudinal groove in accordance with a second embodiment of this disclosure.
Figure 11:
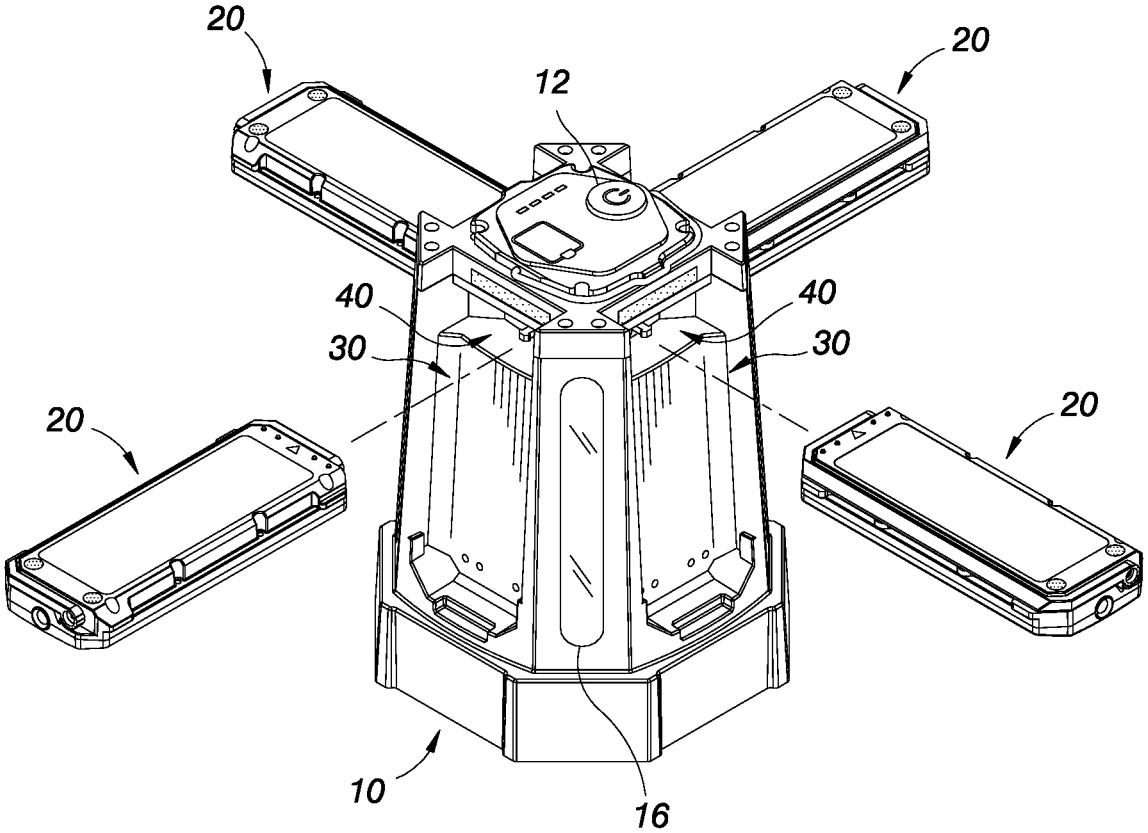
FIG. 11 is a schematic view of a combination of a movable light body and a transverse groove in accordance with the second embodiment of this disclosure.

In an embodiment as shown in FIGS. 10 and 11, each of the four sides of the receptacle 10 is respectively provided with a longitudinal groove 30, and each longitudinal groove 30 is detachably provided with a movable light body 20, and a light-emitting light strip 16 is arranged between every two adjacent longitudinal grooves 30 of the receptacle 10, and the control switch 12 of the receptacle 10 can further control each light-emitting light strip 16 to emit light. As mentioned above, a vertical or horizontal assembly can be adopted as needed, when the four movable light bodies 20 are all removed from the receptacle 10, the receptacle 10 can still emit light through a plurality of light-emitting light strips 16, so that the users can arbitrarily place the light-emitting light strips 16 in the positions that need lighting.

While the invention has been described by means of specific embodiments, numerous modifications and variations could be made thereto by those skilled in the art without departing from the scope and spirit of the invention as set forth in the claims.

What is claimed is:

1. A multifunctional camping light, comprising a receptacle, and at least two movable light bodies detachably installed onto the receptacle, and the receptacle and the two movable light bodies separately having an independent power supply, characterized in that:

the receptacle is substantially in a column shape, and has a top side, and at least two longitudinal grooves formed on a lateral side of the receptacle, and the top side of the receptacle comprises a control switch, and a power I/O interface provided for inputting an external power, storing the electric power, or outputting the electric power to an external electronic device as a power supply, and each longitudinal groove is provided for vertically installing a movable light body and has an inner wall, a top and a bottom, and the bottom of the longitudinal groove is provided with a first terminal module, and the top of the longitudinal groove is concavely formed with a transverse groove for horizontally installing one of the movable light bodies, and the transverse groove is provided with a second terminal module;

each movable light body is substantially in a flat shape, and comprises a first functional surface installed with a solar panel, a second functional surface configured to be opposite to the first functional surface and installed with a light-emitting light board, a first end portion installed with a projecting lamp, a second end portion installed with a third terminal module, and an operating switch;

when the movable light body is vertically assembled into one of the longitudinal grooves of the receptacle, the first functional surface abuts against an inner wall of the longitudinal groove, and the second functional surface faces outward relative to the receptacle, and the third terminal module is electrically coupled to the first terminal module of the longitudinal groove, such that the control switch of the receptacle can control the second functional surface of the movable light body to face outward and emit light, and to charge the movable light body;

when the movable light body is horizontally assembled into one of the transverse grooves of the receptacle, the first functional surface faces upward, and the second functional surface faces downward, and the second end portion is plugged and positioned in the transverse groove, such that the third terminal module is electrically coupled to the second terminal module of the transverse groove, and the control switch of the receptacle can control the second functional surface of the movable light body to emit light downward, and the solar panel facing upward can receive and convert solar radiation into electrical energy for charging the movable light body or the receptacle; and when any movable light body is removed from the receptacle, the operating switch of the movable light body can control of the light-emitting light board on the second functional surface or a projecting lamp of the first end portion to emit light which is used as an illuminating light or a flashlight, and the solar panel can receive and convert solar radiation into electrical energy which is stored in the movable light body.

2. The multifunctional camping light of claim 1, wherein the transverse groove is provided with a positioning column therein, and the second end portion of the movable light body opposite to the positioning column is provided with a positioning hole, and the positioning hole is provided with an elastic positioning plate therein; when the movable light body is horizontally assembled into the transverse groove, the positioning column of the transverse groove is detachably embedded into the positioning hole of the movable light body, and elastically positioned by the elastic positioning plate to prevent the movable light body from separating from the transverse groove.

3. The multifunctional camping light of claim 1, wherein both sides of the bottom of each longitudinal groove of the receptacle are respectively and convexly provided with two stop blocks, and both sides of the second end portion of the movable light body opposite to the two stop blocks are provided with two ribs respectively, and when the movable light body is vertically assembled into the longitudinal groove, the two ribs at the second end portion of the movable light body abut against the rear sides of the two corresponding stop blocks respectively to prevent the movable light body from separating from the longitudinal groove to the outside.

4. The multifunctional camping light of claim 1, wherein the longitudinal groove is provided with a first magnetic part, and each movable light body configured to be opposite to the first magnetic part is provided with a second magnetic part, and when the movable light body is vertically assembled onto the receptacle, the movable light body can be positioned by the mutual magnetic attraction of the first magnetic part and the second magnetic part.

5. The multifunctional camping light of claim 1, wherein the receptacle is substantially in a rectangular column shape and comprises four sides, and the two longitudinal grooves are disposed on two corresponding sides, and the other two corresponding sides are provided with at least one second light-emitting light board, and the control switch of the receptacle can further control the two second light-emitting light boards to emit light.

6. The multifunctional camping light of claim 1, wherein the receptacle is substantially in a rectangular column shape and comprises four sides, and each side is provided with a longitudinal groove, and each longitudinal groove is detachably provided with a movable light body.

7. The multifunctional camping light of claim 1, wherein the receptacle comprises a light-emitting light strip installed between every two adjacent longitudinal grooves, and the control switch of the receptacle can further control each light-emitting light strip to emit light.

8. The multifunctional camping light of claim 1, wherein the two movable light bodies are provided with a liftable or hangable handle.

9. The multifunctional camping light of claim 1, wherein the top side of the receptacle is further provided with a liftable force applying handle.

10. The multifunctional camping light of claim 1, wherein the independent power supply of the receptacle comprises a storage battery and a control circuit board, and the storage battery, the control circuit board, the power I/O interface, the control switch and the first and second terminal modules are electrically coupled to one another.

11. The multifunctional camping light of claim 1, wherein the independent power supplies of the two movable light bodies separately comprise a battery and a circuit board, and the storage battery, the circuit board, the light-emitting light board, the solar panel, the projecting lamp, the third terminal module and the operating switch are electrically coupled to one another.

* * * * *